United States Patent [19]

McCullough

[11] Patent Number: 4,672,776

[45] Date of Patent: Jun. 16, 1987

[54] CIRCULAR BLADE SHARPENING DEVICE

[76] Inventor: Timothy J. McCullough, 833 Aurora Rd., Vermilion, Ohio 44089

[21] Appl. No.: 737,791

[22] Filed: May 28, 1985

Related U.S. Application Data

[63] Continuation-in-part of Ser. No. 540,782, Oct. 11, 1983, abandoned.

[51] Int. Cl.[4] ..... B24B 3/36

[52] U.S. Cl. ..... 51/50 R; 51/34 E; 51/95 WH; 51/105 R; 51/288; 74/89.15; 74/424.8 B

[58] Field of Search ..... 51/34 C, 34 R, 34 E, 51/34 G, 45, 50 R, 51, 56 R, 95 R, 95 WH, 103 C, 105 R, 109 BS, 106 R, 123 R, 129, 131.1, 132, 165.75, 165.86, 165.81, 218 A, 219 R, 224, 225, 232, 237 R, 240 R, 288; 74/89.15, 424.8 B, 424.8 R

[56] References Cited

U.S. PATENT DOCUMENTS

| | | | |
|---|---|---|---|
| 1,872,096 | 8/1932 | Runshang . | |
| 1,875,547 | 9/1932 | Anderson . | |
| 1,981,174 | 11/1934 | Hille | 51/225 X |
| 2,120,198 | 6/1938 | Blazek et al. | 51/50 R |
| 2,136,188 | 11/1938 | Gagne et al. | 51/95 R |
| 2,392,667 | 1/1946 | Hawkinson | 51/237 R |
| 2,431,126 | 11/1947 | Knapp | 51/50 R |
| 2,982,062 | 5/1961 | Jackson et al. | 51/131.1 X |
| 2,998,676 | 9/1961 | Hawkins | 51/45 |
| 3,114,989 | 12/1963 | Allison | 51/105 R |
| 3,279,126 | 10/1966 | Barron | 51/95 R X |
| 3,349,485 | 10/1967 | Bettcher | 30/138 |
| 3,387,411 | 6/1968 | Atzberger | 51/95 R |
| 3,402,613 | 9/1968 | Neusel et al. | 74/89.15 |
| 3,406,486 | 10/1968 | Bettcher | 51/5 R |
| 3,461,613 | 8/1969 | Schnepp | 51/50 R |
| 3,553,898 | 1/1971 | Nobile | 51/219 R X |
| 3,896,591 | 7/1975 | Ruble | 51/132 X |

FOREIGN PATENT DOCUMENTS

| | | | |
|---|---|---|---|
| 1577309 | 4/1966 | Fed. Rep. of Germany | 51/288 |
| 554466 | 7/1943 | United Kingdom | 51/45 |
| 673903 | 6/1952 | United Kingdom | 51/50 R |

*Primary Examiner*—Robert P. Olszewski

*Attorney, Agent, or Firm*—Sand & Hudak Co.

[57] ABSTRACT

A sharpening device for a circular-shaped blade of the type used on a rotary meat trimming knife. The blade is rotatably mounted on a power driven blade holder which is movable horizontally along a base. A grinder which includes a motor and a power driven grinding wheel also is movable horizontally along the base whereby the paths of movement of the blade holder and grinder intersect with the grinding wheel engaging the cutting and edge of the blade at a predetermined angle. A sharpening control mechanism has a course advancement consisting of a threaded shaft which is slidably rotatably mounted in the base and is connected to the blade holder by a follower pin whereby rotation or linear movement of the shaft will move the blade holder linearly along the base and bring the blade into contact with the grinding wheel. A vernier control lever is engaged with the threaded shaft and is manually moved by an operator to forwardly advance the blade holder and blade a predetermined linear fine adjustment distance as the grinding wheel is reciprocated along its direction of travel causing momentary linear crossing contact between the grinding wheel and blade cutting edge to remove a predetermined amount of material from the blade cutting edge without generating excess heat in the blade or grinding wheel.

29 Claims, 19 Drawing Figures

CIRCULAR BLADE SHARPENING DEVICE

CROSS REFERENCE

This application is a Continuation-In-Part of pending application Serial No. 540,782, filed Oct. 11, 1983, now abandoned.

TECHNICAL FIELD

The invention relates to sharpening devices for knife blades and in particular for circular-shaped blades of the type used on meat trimming knives. More particularly, the invention relates to an improved sharpening device which provides a vernier sharpening control mechanism for removing only a relatively small predetermined quantity of blade material when sharpening the cutting edge preventing removal of excess blade material thereby increasing the blade life.

BACKGROUND ART

Meat trimming knives which are used in the meat processing industry for removing meat from bones, have a power driven circular-shaped cutting blade mounted on a manually movable handle. Examples of such circular cutting blades and meat trimming knives are shown in U.S. Pat. Nos. 3,024,532; 3,269,010; 4,324,043; and 4,363,170. The circular blades are removably mounted on the trimming knife and are generally sharpened by the meat trimmer or maintenance office personnel at the end of each work shift or every two or three days depending upon the particular trimming operation being performed to maintain a sharp cutting edge on the blade at all times. A sharp blade increases the efficiency of the trimming knife and reduces hand fatique of the operator.

These existing knife blades are sharpened by hand filing which, although producing a good result, is both time consuming and inaccurate unless performed by a skilled individual or by a sharpening device which was mounted directly on the cutting knife such as shown in U.S. Pat. No. 3,359,485, or by mounting the knife on a grinding machine such as shown in U.S. Pat. No. 3,406,486. These prior sharpeners either had to be located at the meat trimming station which is not satisfactory due to the cleanliness requirements and condition at the trimming stations, or required the knife to be disconnected from its power supply at the work station and carried to a remote sharpening station. Both of these prior sharpening devices are inconvenient and time consuming thereby increasing operating costs.

Another problem with existing knife sharpeners is that the operator when sharpening the knife, usually will remove more blade material than necessary in forming a sharp cutting edge since the sharpening is done by a trial and error technique usually until the operator believes or feels that the edge is sufficiently sharp. Removal of excess blade material even, when measured in thousands of an inch, reduces the blade life considerably by reducing the axial length of the blade requiring the operator to prematurely discard the blade.

Thus, the need has existed for a blade sharpener which will automatically ensure that only a predetermined quantity of material is removed from the blade edge sufficient to provide a sharpened cutting edge thereby increasing considerably the blade life, and in which only the blade, after removal from the meat trimming knife, is mounted on the sharpening device.

DISCLOSURE OF THE INVENTION

Objectives of the invention include providing an improved sharpening device for circular-shaped cutting blades of the type used for meat trimming knives, in which the blade is sharpened after removal from the knife requiring only the blade to be transported between the meat trimming station at which the knives are located and a sharpening station.

Another objective is to provide such a sharpening device in which the blade is mounted by a usual collet on a power driven blade holder that is movably mounted on a support base and whose travel path intersects the travel path of a power driven grinding wheel that is rotatably mounted on the shaft of an electric driven motor which also is movably mounted on the support base adjacent the blade holder.

Still another objective is to provide such a sharpening device in which the grinding wheel is moved into contact with the blade by movement of the grinder along the base by a manually actuated operating handle, and in which the blade holder is moved into contact with the grinder by an improved control mechanism having a course adjustment and a fine vernier adjustment enabling only a predetermined amount of blade material to be removed from the blade when sharpening the cutting edge.

A further objective is to provide such a sharpening device in which the improved blade sharpening control mechanism is mounted on the base on which the blade holder and grinder are mounted and is controlled by a simple hand wheel and adjustment lever located adjacent a manually operated lever for reciprocating engagement of the grinding wheel with the blade edge.

Another objective is to provide such a sharpening device in which the device can sharpen blades at a predetermined angle even 90° or perpendicular to the axis of the circular-shaped blade, and in which the blade holder and sharpening stone are rotated by usual electric driven motors operated by a usual source of AC voltage.

These objectives and advantages are obtained by the improved sharpening device for circular-shaped blades, the general nature of which may be stated as including a base; a power driven blade holder movably mounted on the base for rotatably mounting a knife blade, said blade holder being movable in a predetermined horizontal linear path on said base; a grinder having a power driven rotating grinding wheel movably mounted on the base for movement in a horizontal linear path which intersects the horizontal linear path of the blade holder whereby the grinding wheel engages and passes beyond the cutting edge of a knife blade mounted on the blade holder at a predetermined angle for sharpening said cutting edge; and manually actuated sharpening control means for individually reciprocally moving the grinding wheel and blade holder along their respective horizontal paths to bring the wheel into initial contact with the cutting edge of the blade, with said control means further including vernier means for effecting a subsequent predetermined limited horizontal movement along the horizontal linear path of either one of the blade holder and grinder to sharpen the blade cutting edge by grinding a predetermined amount of material from the blade by said limited horizontal movement as the other of said blade holder and grinder is reciprocated along its direction of travel causing momentary linear crossing contact between the grinding wheel and the blade cutting edge.

BRIEF DESCRIPTION OF THE DRAWINGS

Preferred embodiments of the invention illustrative of the best modes in which applicant has contemplated applying the principles are set forth in the following description and are shown in the drawings and are set forth in the appended claims.

Similar numerals refer to similar parts throughout the drawings.

BEST MODE FOR CARRYING OUT THE INVENTION

First Embodiment

Figure 1:
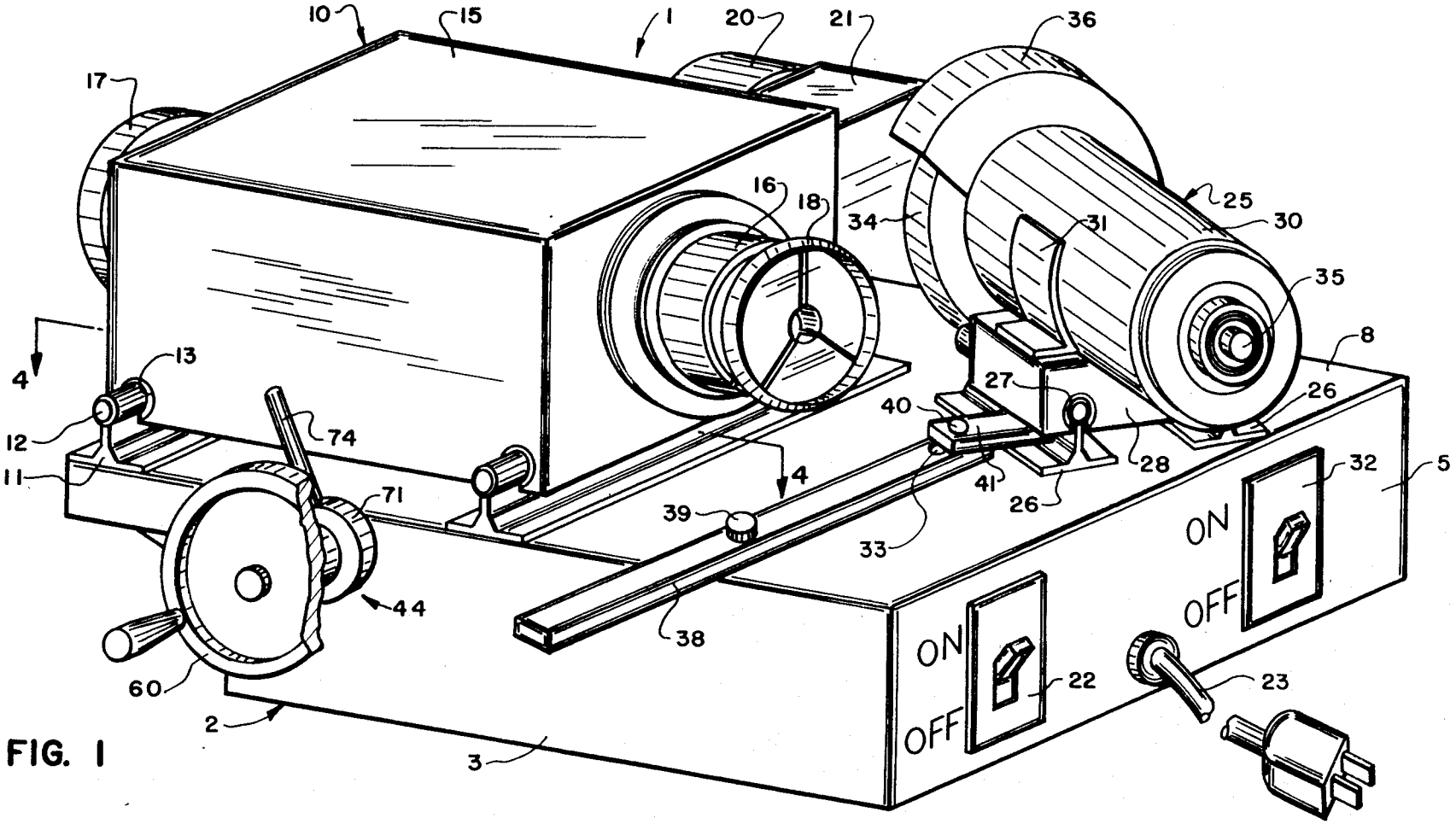
FIG. 1 is a perspective view with portions broken away of a first embodiment of the improved circular-blade sharpening device.

The improved knife sharpening device is indicated generally at 1, and is shown in FIGS. 1 through 8. Sharpener 1 includes a rectangular-shaped base 2 formed by spaced side walls 3 and 4, end walls 5 and 6, and a supporting platform 7.

A blade holder indicated generally at 10, is slidably mounted on top surface 8 of base platform 7 by a pair of slide rails 11. Rails 11 are provided with longitudinal cylindrical bearings 12 which are engaged in complementary-shaped bushing grooves 13 formed in the bottom of blade holder 10. Blade holder 10 includes a collet housing 15 in which a usual collet 16 is operatively mounted and controlled by a clamping wheel 17 located at one end thereof, for clamping and holding a circular-shaped knife blade 18 on blade holder 10.

Collet 16 and its manner of operation for mounting blade 18 on holder 10 is of a usual construction and therefore is not shown in greater detail. An electric motor 20 (FIG. 2) is connected through a gear box 21 to collet 16 within housing 15 for rotating collet 16. Motor 20 is controlled by an electric switch 22 mounted on end wall 5 of base 2 and is connected to a source of AC electric power by an electric conductor 23. Movement of blade holder 10 along base 2 moves blade 18 along a path indicated by dot dash lines 24 in FIG. 2.

A grinder indicated generally at 25, is horizontally slidably mounted on top surface 8 of base 2 by a pair of slide rails 26 which are similar to slide rails 11. Slide rails 26 are engaged in complementary-shaped bushings 27 formed in a mounting base 28 of grinder 25. An electric motor 30 is mounted on base 28 by a bracket 31 or similar mounting means and is controlled by an on-off switch 32 mounted on front wall 5 of base 2 adjacent blade holder motor switch 22. The electric power for grinder motor 30 also may be supplied through conductor 23 which supplies the electric power to blade holder motor 20. A grinding or sharpening wheel 34 is rotatably mounted on motor shaft 35 and preferably has a safety guard 36 surrounding a major portion of the wheel.

Figure 2:
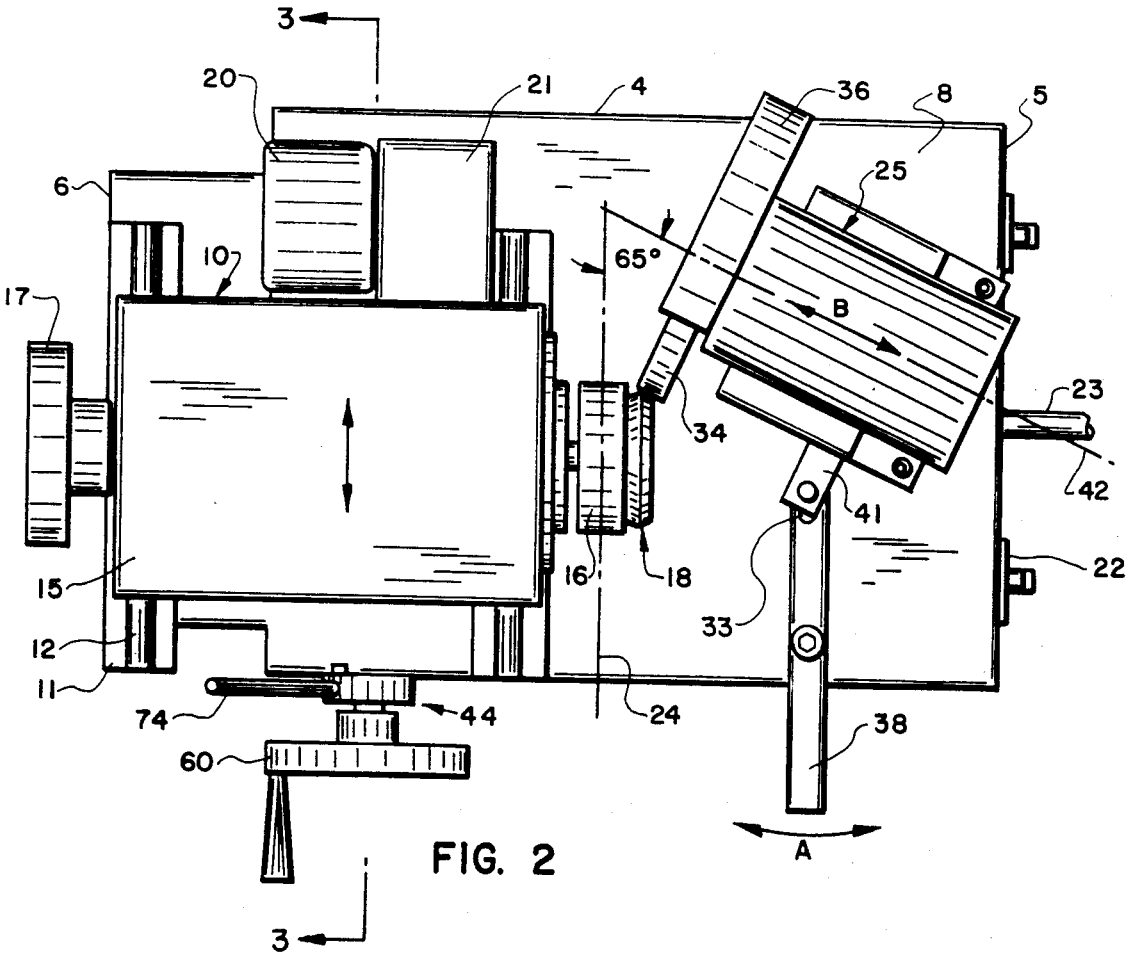
FIG. 2 is a reduced top plan view of the blade sharpening device shown in FIG. 1 with the grinding wheel shown in sharpening engaged position with a knife blade.

Grinder 25 is moved manually along slide rails 26 by a lever 38 which is pivotally mounted by a pin 39 on top surface 8 of base 2. Lever 38 is connected by another pivot pin 40 which projects through a slot 33 formed in lever 38 to a stub lever 41 attached to grinder base 28. Thus, manual pivotal movement of lever 38 will move grinder 25 toward and away from blade holder 10 with grinder 25 and wheel 34 following a linear path of movement indicated by dot dash line 42 in FIG. 2 and will intersect travel path 24 of blade 18 due to the slotted pin connection between lever 38 and stub lever 41. The angle of intersection for the embodiment of FIG. 2 is approximately 65° which will provide an angle of 25° on the cutting edge.

In accordance with one of the main features of the invention, an improved sharpening control means indicated generally at 44 (FIG. 3), is mounted on platform 7 of base 2 for controlling the movement of blade holder 10 and correspondingly the movement of blade 18 to achieve the desired sharpening results upon engagement with grinding wheel 34.

A control shaft indicated generally at 45, is slidably rotatably mounted within a complementary-shaped cylindrical opening 46 formed in platform 7. Opening 46 extends throughout a major portion of platform 7 extending from an open end 47 at side wall 3 and terminating in a closed inner end located closely adjacent end wall 4. Shaft 45 includes an intermediate threaded portion 48 having a plurality of helical threads 50 separated by complementary grooves 51. Inner end 52 of shaft 45 has a smooth cylindrical configuration terminating in a rounded end 53 which engages a metal ball 54. Ball 54 is biased into engagement with shaft end 53 by a coil spring 55. The opposite end of shaft 45 has a smooth cylindrical portion 57 which terminates in a reduced diameter cylindrical outer shaft end 58 separated by an annular shoulder 59. A hand wheel 60 is attached by a set screw 61 on outer end 58 of shaft 45 for manually rotating shaft 45 within base opening 46.

Figure 6:
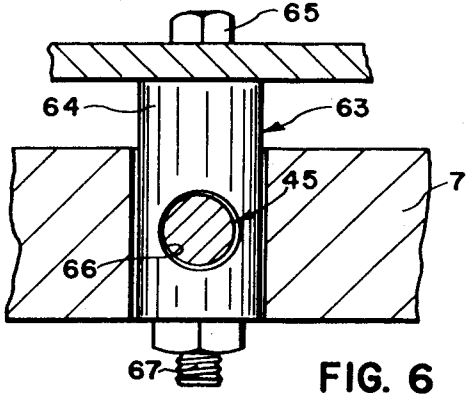
FIG. 6 is a fragmentary sectional view taken on line 6—6, FIG. 3.

Blade holder 10 is operatively connected to shaft 45 by a follower pin assembly indicated generally at 63 (FIG. 3), which includes a cylindrical block 64 connected by a bolt 65 to collet housing 15 (FIG. 6). Block 64 projects upwardly through an elongated slot 69 (FIG. 4) formed in base platform 7. Shaft 45 extends through a horizontally extending hole 66 formed in block 64 and is engaged by the tapered end 68 of a follower pin 67 mounted in block 64. Tapered end 68 of pin 67 is engaged in grooves 51 of threads 50. Rotation of shaft 45 by hand wheel 60 will rotate threaded shaft portion 48 moving blade holder 10 linearly along slide rails 11 by the engagement of follower pin 67 in threaded grooves 51.

Figure 3:
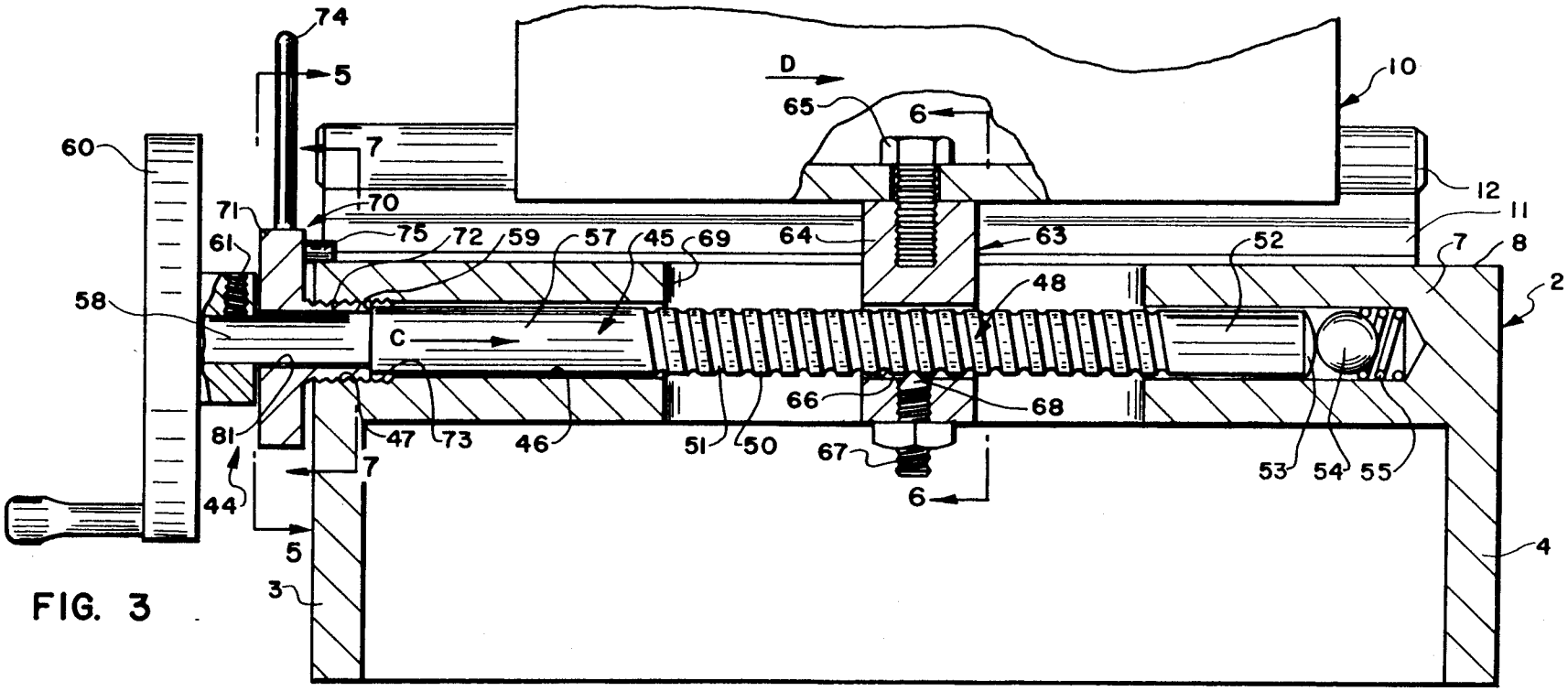
FIG. 3 is an enlarged fragmentary sectional view taken on line 3—3, FIG. 2 showing the blade sharpening control means including a vernier control mechanism.
Figure 7:
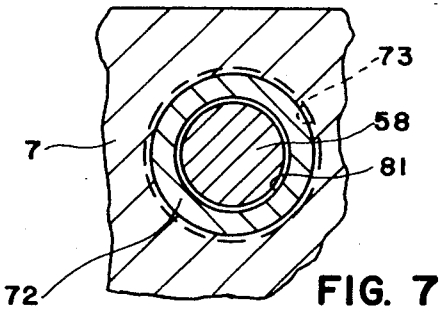
FIG. 7 is an enlarged fragmentary sectional view taken on line 7—7, FIG. 3.

In accordance with another of the main features of the invention, sharpener control means 44 includes a vernier control mechanism indicated generally at 70. Vernier mechanism 70 is mounted on base 2 and is operatively engaged with threaded shaft 45 as shown in FIG. 3. Vernier mechanism 70 includes a disc-shaped lever 71 (FIG. 5) having a threaded outwardly extending hub 72 which is threadably engaged with an internally threaded section 73 formed at outer open end 47 of cylindrical opening 46. A rod 74 is mounted on and extends upwardly from lever 71 for conveniently rotating lever 71. A stop pin 75 is mounted on the inner surface of lever 71 and extends horizontally outwardly toward base 2, and is adapted to engage top surface 8 of base platform 7. Spring 55 biases threaded shaft 45 toward outer open end 47 of cylindrical opening 46 forcing shaft shoulder 59 against the inner end of lever hub 72 which retains shaft 45 within opening 46 (FIG. 3).

Figure 8:
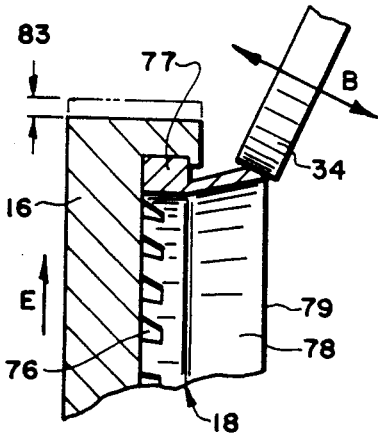
FIG. 8 is an enlarged fragmentary sectional view showing the grinding wheel sharpening a knife blade of the type mounted on the sharpening device of FIGS. 1 and 2.

The mode of operation of sharpener control means 44 and particularly of vernier control mechanism 70, is set forth below in describing a knife sharpening procedure. One type of blade 18 to be sharpened by sharpener 1 is shown in FIG. 8 and is of the type of blade shown in U.S. Pat. No. 4,363,170. Blade 18 is of a usual construction and consists of gear teeth 76 extending circumferentially about the top of the blade with a mounting shoulder 77 formed between gear teeth 76 and conical blade wall 78. The other end of blade wall 78 terminates in an annular sharpened cutting edge 79.

Figure 5:
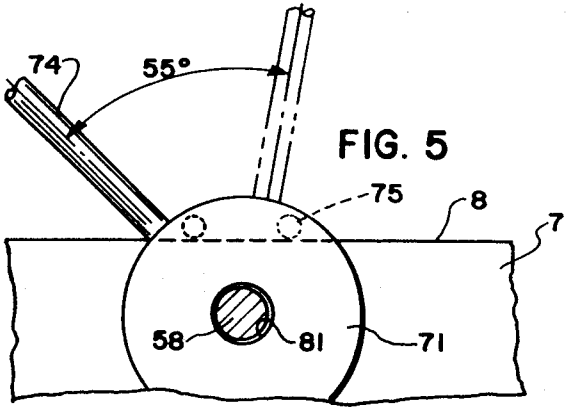
FIG. 5 is a fragmentary sectional view taken on line 5—5, FIG. 3 showing the vernier control lever in retracted and forward position.
Figure 4:
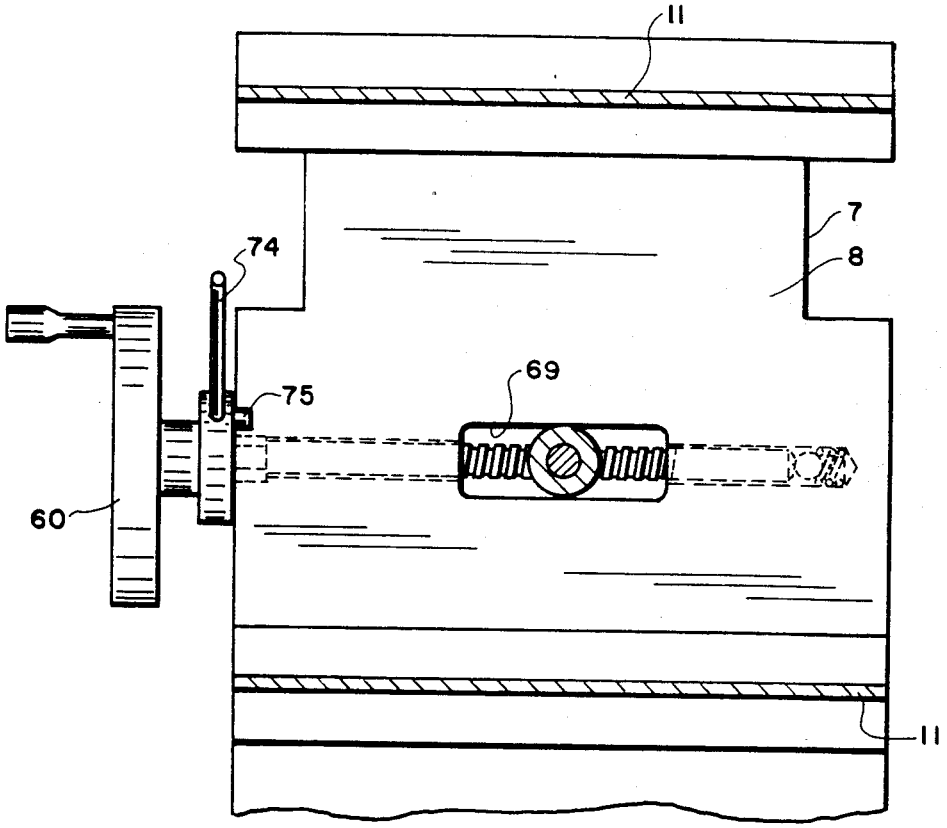
FIG. 4 is an enlarged fragmentary sectional view taken on line 4—4, FIG. 1.

A blade 18 is mounted on collet 16 and is moved along base 2 following its linear horizontal path 24 (FIG. 2) by operation of hand wheel 60 until blade 18 intersects and contacts grinding wheel 34 of grinder 25 which is moved along its travel path 42 by pivotal movement of lever 38. Vernier mechanism 70 is in its retracted or outer position as shown in FIG. 3 and in full lines in FIG. 5. Rotation of threaded shaft 45 by wheel 60 to move blade holder 10 horizontally along base 2, has no affect on vernier mechanism 70 since reduced shaft end 58 rotates freely within smooth bore 81 of lever hub 72 (FIG. 7) with shaft shoulder 59 slidably rotating against the inner end of hub 72. Upon intersection and engagement of blade 18 with grinding wheel 34, the operator will cease further movement of blade holder 10 by rotation of hand wheel 60. The operator with one hand will pivot grinder lever 38 as indicated by arrow A, FIG. 2, reciprocating grinder wheel 34 forward and back along its path 42 contacting blade edge 79 at the desired angle for removing material from the blade to sharpen edge 79. While moving wheel 34 in this back-and-forth direction illustrated by arrow B (FIGS. 2 and 8) the operator will slowly move control rod 74 and correspondingly lever 71 from the full line position of FIG. 5 to the dot-dash line position thereof. This movement of rod 74 will advance disc hub 72 inwardly along internally threaded section 73 of base opening 46, moving shaft 45 linearly in the direction of arrow C (FIG. 3) toward the rear of cylindrical opening 46. This linear movement of shaft 45 will move connected blade holder 10 in the direction of arrow D a predetermined linear amount depending on the arcuate rotation of lever 71 and corresponding linear movement of shaft 45. Lever 71 will rotate a predetermined arcuate distance such as 55° as shown in FIG. 5 determined by the setting of stop pin 75 which engages top surface 8 of platform 7 which determines the retracted and forward positions of hub 72. This limited horizontal linear movement of blade holder 10 and correspondingly of blade 18 which is indicated at 83 in FIG. 8 and shown greatly exaggerated will move blade 18 toward the rotating grinding wheel 34 (arrow E, FIG. 8) insuring that only a predetermined amount of material is removed from blade edge 79 by the reciprocal movement of grinding wheel 34.

The linear movement of blade holder 10 and correspondingly blade 18 through the arcuate rotation of lever 71 usually is in order of 0.01 inches which experience has indicated is a sufficient amount of material to be removed from blade wall 78 to sharpen edge 79. This vernier control feature enables only a sufficient amount of material to be removed from the blade edge to provide a sharpened edge without removing an excess material as occurs in prior sharpening devices. This accurately controlled removal of material from the blade wall permits repeated efficient sharpening of the blade and extension of blade life. Thus, vernier mechanism 70 provides a highly efficient means of sharpening the blade by removing only the required amount of material from the blade edge.

Second Embodiment

Sharpener construction 1 described above is preferably used for knife trimming blades in which the sharpening edge is formed by sharpening the blade at an angle as shown in FIG. 8. Other types of trimming knife blades have a radially inwardly extending cutting edge of the type shown in U.S. Pat. No. 3,024,532 wherein the blade is sharpened in a direction perpendicular to the central axis 84 of the ring blade as shown in FIG. 10.

Figure 9:
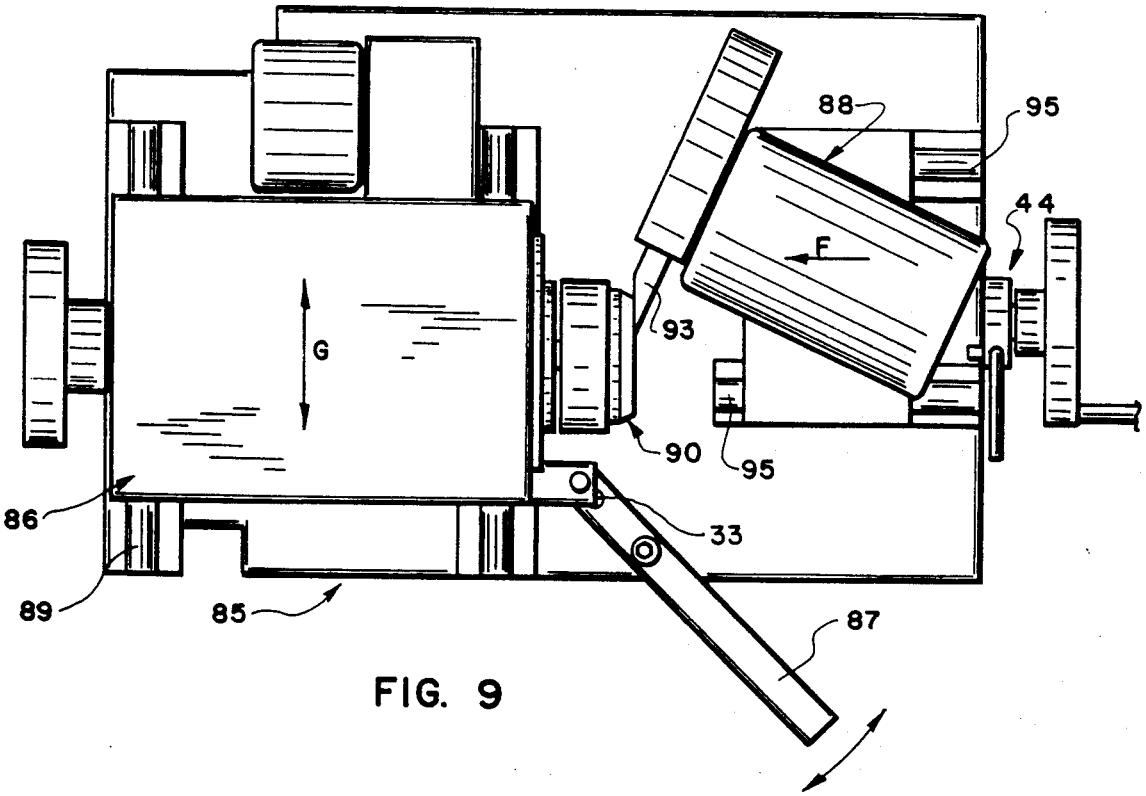
FIG. 9 is a top plan view similar to FIG. 2 showing a second embodiment of the improved blade sharpening device.

A modified form of the improved sharpening devices for sharpening such perpendicularly sharpened blades is shown in FIG. 9 and is indicated generally at 85. The main differences between the construction of sharpener 85 with respect to sharpener 1, is that blade sharpener 88 of sharpener 85 is moved linearly along its slide mounting rails 95 by improved sharpening control mechanism 44 as described above instead of mechanism 44 moving the blade holder as in sharpener 1. Also, the path of blade sharpener 88 is perpendicular to the path of movement of blade holder 86. In this embodiment, a blade 90 is shown being sharpened in FIGS. 9 and 10 and requires controlled movement of grinding wheel 93 in the direction of arrow F which is parallel to the axis 84 of blade 90 and perpendicular to the direction of movement of the blade.

Figure 10:
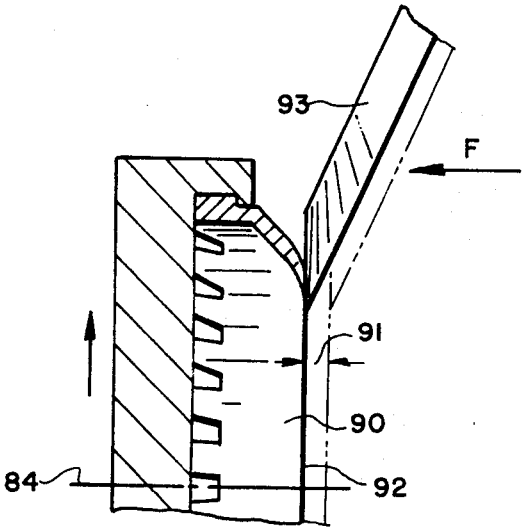
FIG. 10 is an enlarged fragmentary sectional view similar to FIG. 8, showing the grinding wheel sharpening a knife of the type shown on the sharpening device of FIG. 9.

In sharpening blade 90 with modified sharpener 85 reciprocation of blade holder 86 in the horizontal linear direction indicated by arrow G (FIG. 9) in combination with the vernier movement of grinder 88 in the direction of arrow F enables the desired amount of blade material indicated at 91 and shown greatly exaggerated in FIG. 10, to form the new sharpened edge 92. Again, the limited controlled movement of grinding wheel 93 by vernier mechanism 70, ensures that only the necessary amount of blade material is removed to provide a sharpened edge in contrast to the heretofore trial and error sharpening procedure generally resulting in excess material being removed from the blade.

Third Embodiment

A further modification of the improved blade sharpener is shown in FIGS. 11–19 and is indicated generally at 100. Sharpener 100 is similar to sharpeners 1 and 85 and combines the features thereof in a single unit enabling various types of blades to be sharpened by pivotal movement of the blade holder assembly to a desired angular position with respect to the grinding wheel.

Figure 11:
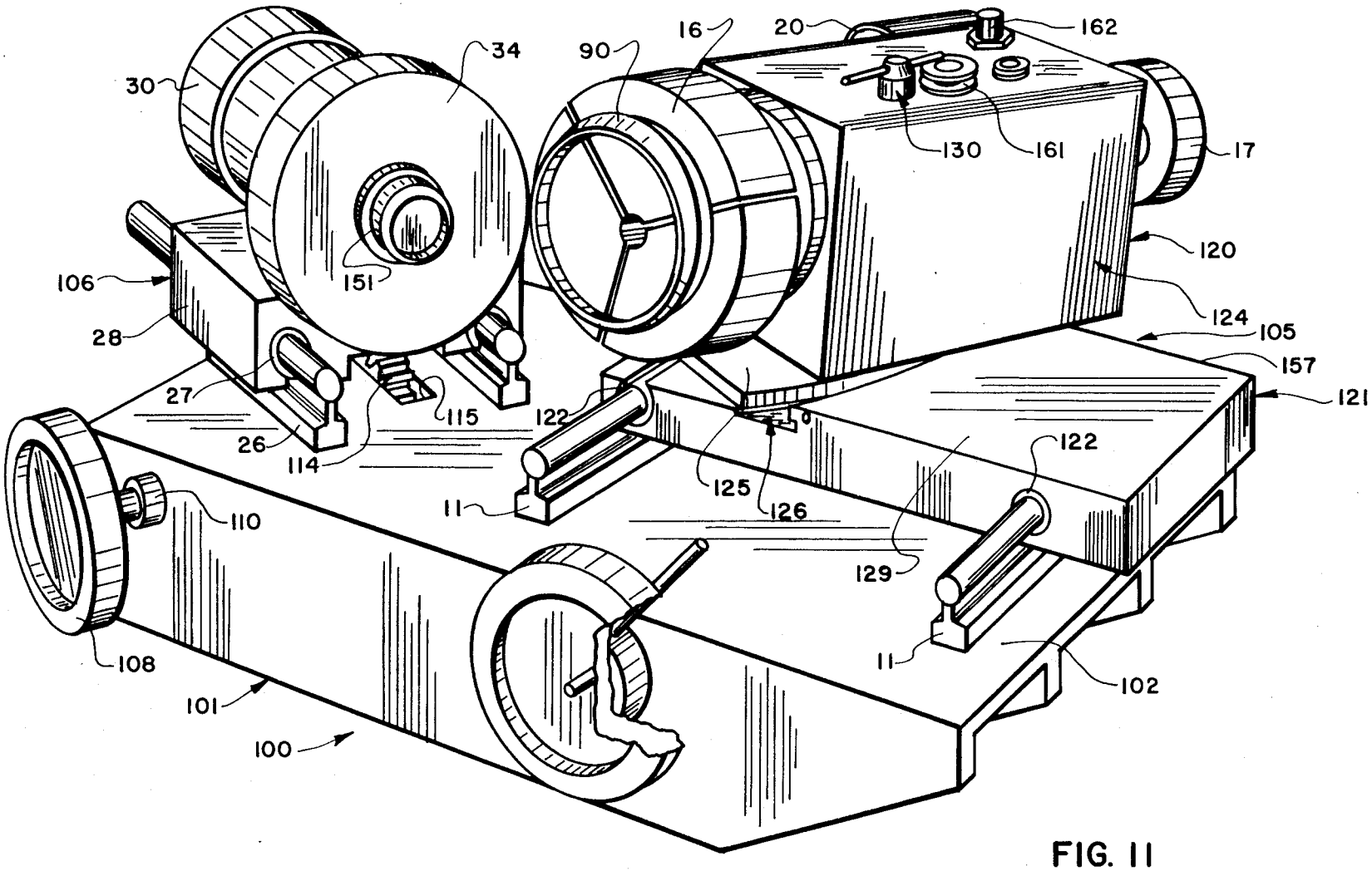
FIG. 11 is a perspective view of a third embodiment of the improved blade sharpening device.

Referring to FIG. 11, blade sharpener 100 includes a base indicated at 101 having a top surface 102 on which spaced cylindrical bearings pairs 11 and 26 are mounted for slidably mounting a modified blade holder assembly indicated generally at 105, and the grinder indicated generally at 106. Grinder 106 is similar to grinder 25 in that it includes base 28, slide bushings 27 and grinding wheel 34 which is driven by motor 30. The main difference between grinder 106 and grinder 25 is the replacement of the operating lever 38 with a rotatable handwheel 108.

Handwheel 108 (FIGS. 12 and 14) includes a shaft 109 which extends through a bushing 110 mounted in base side wall 111. The extended end of shaft 109 is rotatably mounted in another bushing sleeve 112 which is located within a cutout 113 formed in a portion of base 101. A gear 114 is firmly attached to shaft 109 and will rotate with the shaft upon movement of handwheel 108. Gear 114 extends through a slotted opening 115 formed in top surface 102 of base 101 and engages a gear rack 117 (FIG. 14) formed on the bottom surface of grinder mounting base 28 to move grinder wheel 34 linearly horizontally along top surface 102 in a predetermined path shown by imaginary line 118.

In accordance with one of the main features of modified blade sharpener 100, a blade holder indicated generally at 120, is pivotally mounted on a separate platform 121 which is slidably mounted by bushings 122 on slide bearings 11. Blade holder 120 includes a collet housing 124 which is similar to housing 15 of sharpener 1 and which includes collet 16, clamping handwheel 17, reversible motor 20 and gear box 21. Housing 124 includes a bottom plate 125 which is pivotally slidably mounted by a pin 126 (FIG. 14) on horizontal top surface 129 of platform 121. Platform 121 is formed with an arcuate shaped groove 126 (FIGS. 14 and 15) which has a generally inverted T-shaped cross-sectional configuration formed with an enlarged lower channel 127 and a reduced connecting upper channel 128.

Figure 15:
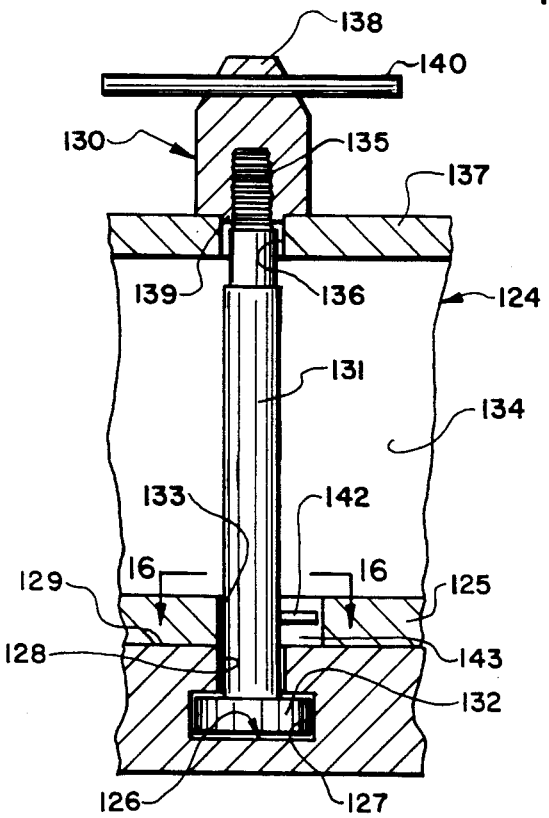
FIG. 15 is an enlarged fragmentary sectional view taken on line 15—15, FIG. 13, showing the locking device for the blade holder assembly.
Figure 16:
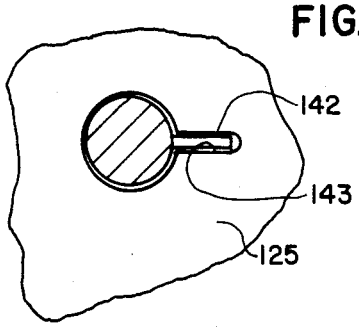
FIG. 16 is an enlarged fragmentary sectional view taken on line 16—16, FIG. 15.
Figure 19:
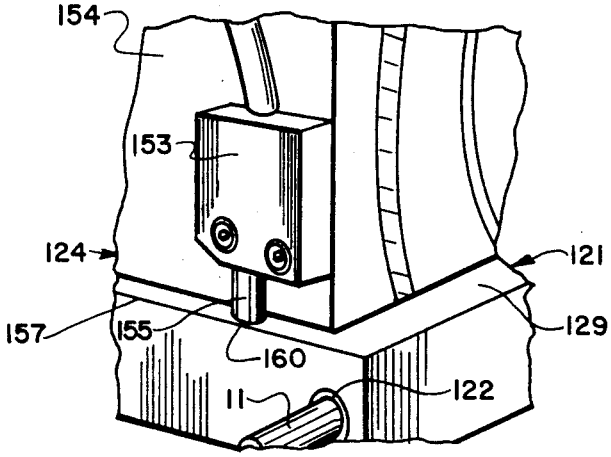
FIG. 19 is a fragmentary perspective view of the control switch for reversing the polarity of the blade holder drive motor.

Blade holder housing 124 including blade holder collet 16 and other components thereof are retained in an adjusted pivotal position on platform 121 by a locking device indicated generally at 130 (FIG. 15). Locking device 130 includes a cylindrical rod 131 which projects into arcuate groove 126 terminating in an enlarged head 132 complementary with lower groove channel 127. Shaft 131 projects through an opening 133 formed in pivot plate 125 and extends through interior 134 of housing 124 and terminates in a threaded upper end 135 which projects through a hole 136 formed in top wall 137 of housing 124.

A locking nut 138 is threadably engaged with the threaded shaft end 135 and has an annular-shaped central boss 139 which extends into housing wall hole 136 for clamping shaft 131 in a selected adjusted position by advancing nut 138 with a rod 140 into clamping engagement with top wall 137. A pin 142 is mounted on shaft 131 (FIGS. 15 and 16) and projects outwardly therefrom and is located within a slot 143 formed in pivot plate 125 to prevent rotation of shaft 131 upon movement of clamping nut 138. Upon rotation of clamping nut 138 against housing top wall 137 enlarged shaft head 132 will move upwardly against the top of lower groove channel 127 to clamp pivot plate 125 tightly against platform top surface 129 securing blade holder housing 124 in an adjusted position.

Figure 14:
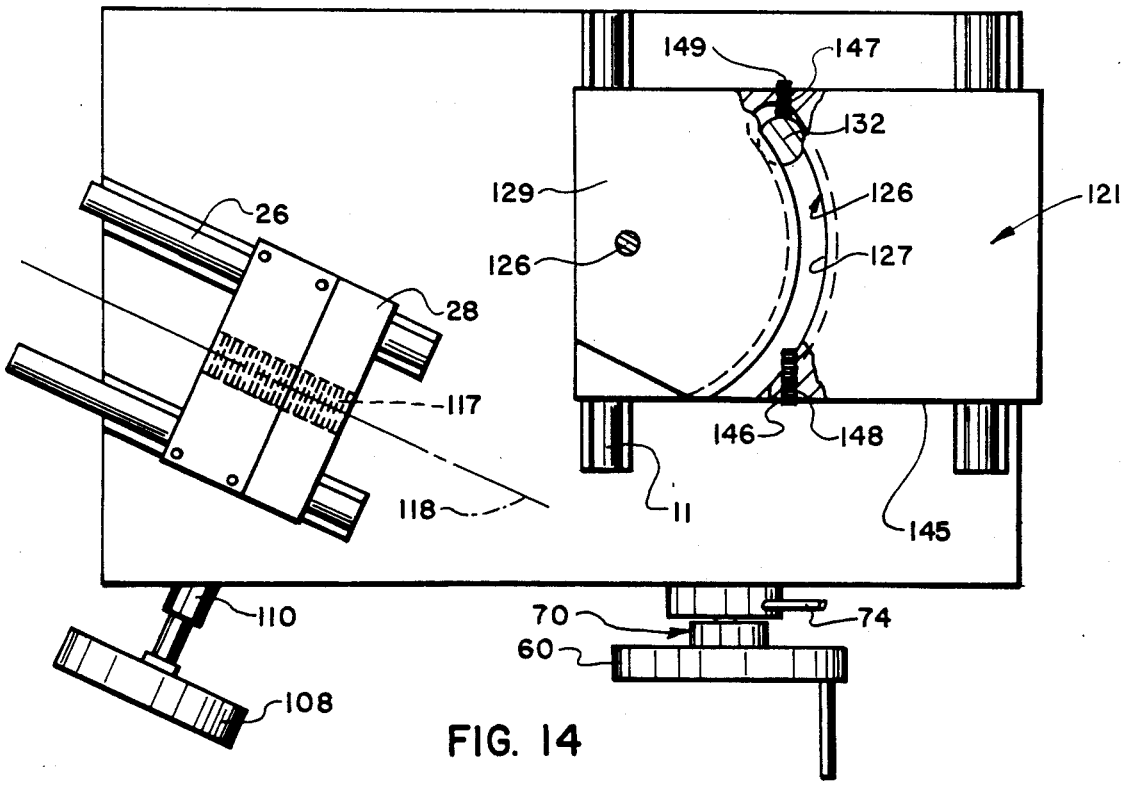
FIG. 14 is a fragmentary, top plan view with portions broken away and in section showing the mounting bases and slide mechanisms for the grinding wheel and blade holder assembly of FIG. 11.

Groove 126 extends from front edge 145 of platform 121 and extends throughout an arch of approximately 65° (FIG. 14). A pair of set screw stops 146 and 147 are adjustably mounted within complementary threaded holes 148 and 149, respectively, which extend horizontally into platform 121 and communicate with lower channel 127 of arcuate groove 126. Screws 146 and 147 engage head 132 of locking device 130 to position blade holder housing 124 in two predetermined adjusted positions for performing the two particular types of blade sharpening operations shown particularly in FIGS. 8 and 10 and described more fully below.

Figure 12:
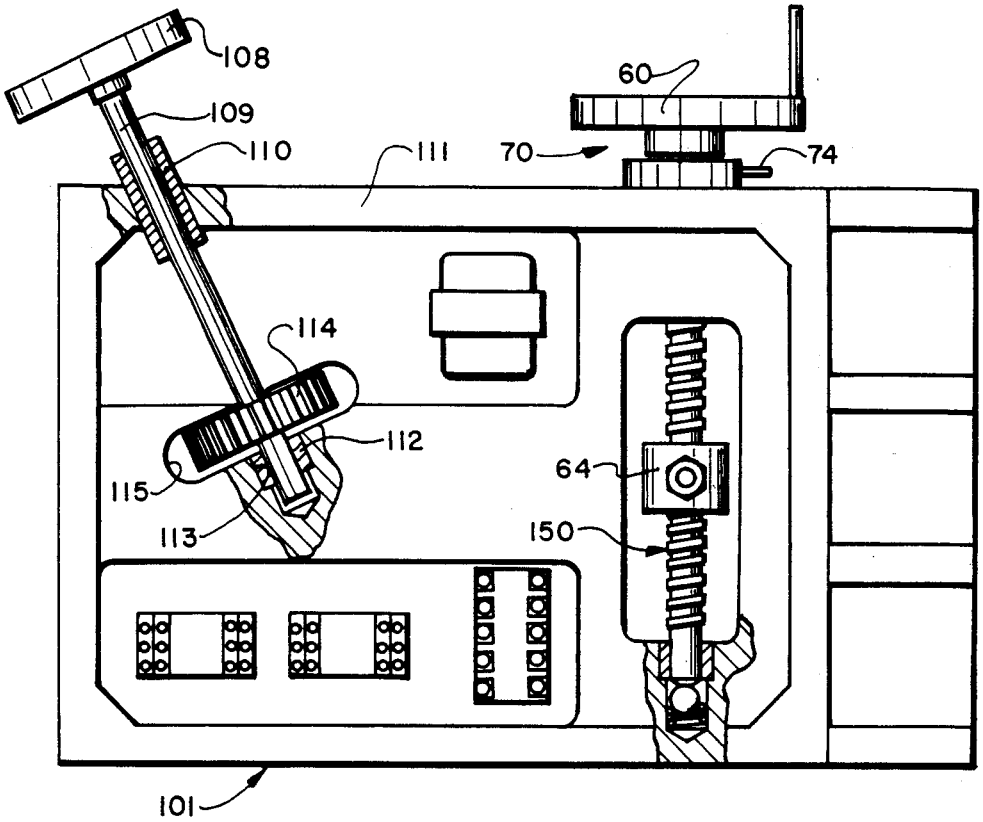
FIG. 12 is a reduced bottom plan view with portions broken away and in section of the sharpening device of FIG. 11.
Figure 13:
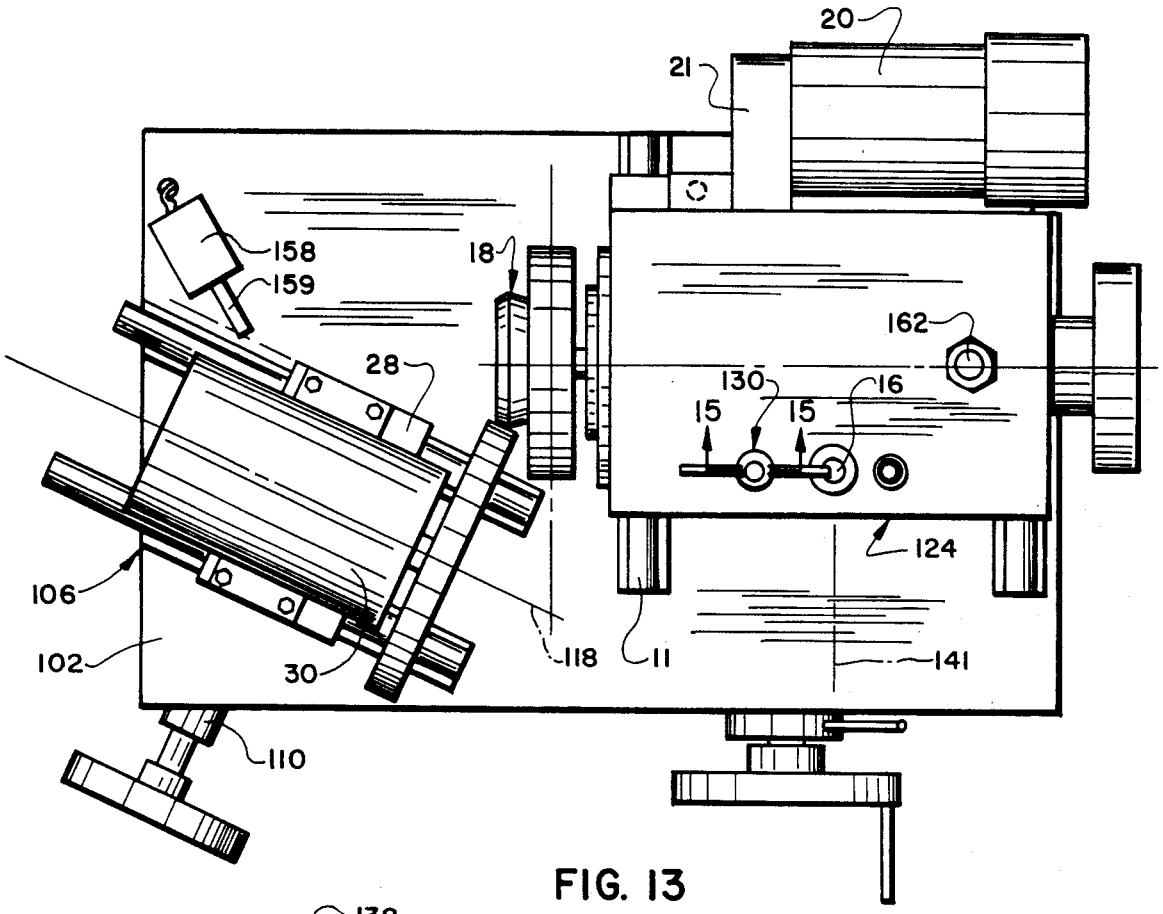
FIG. 13, is a reduced top plan view of the sharpening device of FIG. 11 with the grinding wheel in sharpening contact with a knife blade of the type shown in FIG. 8.

Blade holder 120 including platform 121 is moved horizontally linearly along base 102 on bearings 11 in a predetermined path indicated by imaginary line 141, by a sharpening control means 150 (FIGS. 12 and 13). Control means 150 is similar to control means 44 described above in that it includes a coarse thread adjustment and a fine vernier adjustment. Cylindrical follower pin block 64 is connected to the bottom surface of blade holder platform 121 whereby platform 121 and housing 124 are moved along bearings 11 upon rotation of handwheel 60 and vernier control mechanism 70.

Figure 17:
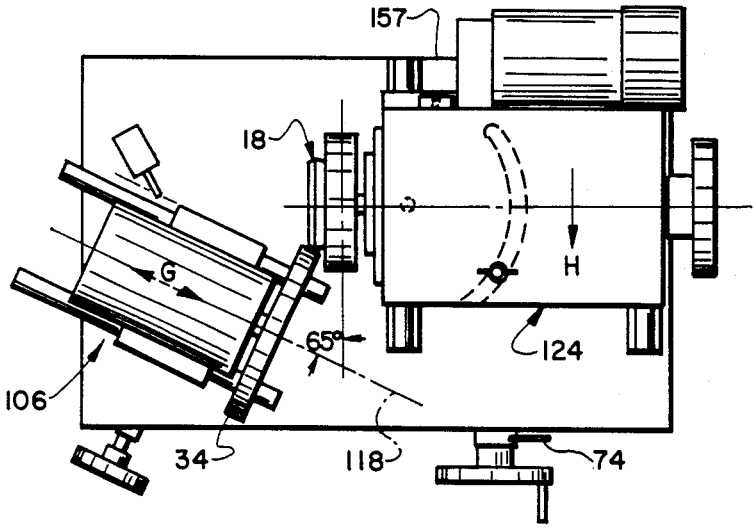
FIG. 17 is a reduced top plan view similar to FIG. 13 showing the grinding wheel in sharpening contact with a knife blade of the type shown in FIG. 8.
Figure 18:
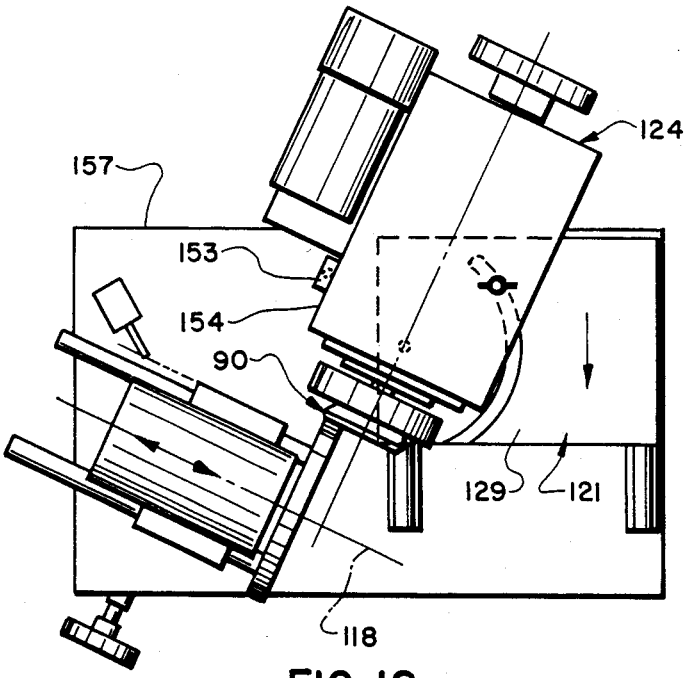
FIG. 18 is a top plan view similar to FIG. 17 showing the grinding wheel in sharpening contact with a knife blade of the type shown in FIG. 10.

The operation of embodiment 100 is shown particularly in FIGS. 13, 17 and 18 and is similar to that described above for sharpeners 1 and 85. A blade 18 similar to that shown in FIG. 8 is mounted in collet 16 as shown in FIGS. 13 and 17. Blade holder housing 124 is pivotally moved on platform 121 until head 132 of locking shaft 131 abuts against the front set screw stop 146 which will place blade 18 and blade holder assembly 120 in the desired position with respect to the horizontal path 118 of grinder assembly 106 to provide an intersecting angle of 65° as shown in FIG. 17. After stop shaft head 132 contacts set screw stop 146, nut 138 is rotated to tightly clamp pivot plate 125 against platform surface 129 to prevent further pivotal movement of blade holder housing 124. Handwheel 108 is then rotated back and forth moving grinder 106 in the direction of arrow G (FIG. 17) with blade holder housing 124 being advanced by the vernier control mechanism in the direction of arrow H by movement of rod 74.

During the vernier advancement of blade 18 in the direction of arrow H (FIG. 17) grinding wheel 34 is reciprocated along its direction of travel causing momentary linear crossing contact with the blade edge until the desired amount of material is removed therefrom. This momentary linear crossing contact prevents excess heat buildup in the grinding wheel and blade which would occur if the blade is brought into direct contact with the grinder or the grinder brought directly into contact with the stationery rotating blade. Such direct contact would result in forming a groove in the grinding wheel and the blade would become scorched due to excess heat buildup. For sharpening the type of blade shown in FIG. 10 and indicated at 90, locking device 130 is merely loosened and blade holder housing 124 and connected plate 125 are pivoted from the position of FIG. 17 to that of FIG. 18 until stop shaft head 132 contacts the rearmost set screw stop 147 as shown in FIG. 14. This will directly position blade 90 which is mounted on collet 16 at the correct position for the linear momentary crossing contact with the grinding wheel as shown in FIGS. 11 and 18.

It is necessary for the rotation of collet 16 and the blade mounted thereon to be reversed while changing from the 90° blade sharpening angle of blade 90 to the 25° blade sharpening angle of blade 18. When in the 25° sharpening position of FIG. 17, the grinder wheel rotates in a clockwise direction and the blade in counterclosewise direction whereas in the 90° blade sharpening position of FIG. 18, the grinder continues to rotate in the clockwise direction as well as the blade. It is desirable that the blade and wheel are always counter rotating to prevent sparks from flying into the face of the operator.

It is difficult to reverse the direction of the grinding wheel because front locking nut 151 would become unloosened in either one of the two rotational directions. Thus, it is preferable that the rotational direction change be accomplished by collet 16 and the blade mounted thereon. This is achieved by the use of a limit switch 153 (FIG. 19) which is mounted on a rear wall 154 of blade holder housing 124. Switch 153 includes a spring biased plunger 155 having a rounded end 160. End 160 rides above rear top edge 157 of platform 121 to depress plunger 155 and actuate limit switch 153 to change the rotation of motor 21 as blade holder housing 124 is pivoted from the position of FIG. 18 to that of FIG. 17. Switch 153 is actuated again as the housing is pivoted in the opposite direction.

A second limit switch 158 is mounted on platform top surface 102 (FIG. 13) and has a plunger 159 which is actuated by grinder mounting base 28 as the grinder is moved from retracted to forward position. Switch 158 provides an electric interlock with the other electrical components of the blade sharpener, including blade drive motor 20, to prevent the motor from rotating the blade until the grinder is in a full retracted position. This prevents the grinder and blade from being brought into accidental contact while both members are rotating prior to the blade and grinder moving from their start positions to the initial engaged position after which the vernier control mechanism is operated to achieve the desired sharpening effect.

Limit switches 153 and 158 are connected in the particular electrical circuitry of the improved blade sharpener including motors 20 and 30. A safety latch switch 161 which will deactuate the entire electrical system for blade sharpener 100 together with a manually operated depress start button 162 also is connected in the electrical circuitry of sharpener 100. The operator must first press latch switch 161 which will energize certain portions of the electrical circuit after which button 162 can be actuated to start motors 20 and 30. As discussed above, limit switch 158 also must be actuated by movement of grinder assembly 106 to its rearward position before grinder motor 30 will be energized to insure that the correct grinding procedure is followed by the operator to prevent damage to the sharpener. Limit switch 153 also is actuated automatically upon movement of blade housing 124 between the two blade sharpening positions to insure the correct rotational direction of the blade drive motor 20.

The particular electrical sequence of operation and mode of operation of the drive motors 20 and 30 may be modified without affecting the concept of the invention. Blade sharpener 100 provides the advantages and features of blade sharpeners 1 and 85 by combining the same in a single device able to sharpen both types of blades by the pivotal movement of blade housing 124. It is understood by anyone skilled in the art that other types of blades may be mounted on collet 16 and sharpened by the angular adjustment of blade housing 124 to a predetermined sharpening angle and need not be limited to the two particular sharpening angles described above.

SUMMARY

The improved blade sharpening device provides an extremely satisfactory device for sharpening circular knife blades by providing a sharpening control means which includes a vernier mechanism for moving the blade and grinding wheel into momentary intersecting crossing contact with each other at the desired angle to form a sharpened edge. More importantly, the sharpening device eliminates the trial and guess work heretofore used for sharpening blade edges by arcuately controlling the amount of metal removed from the blade wall by the grinding stone in forming the sharpened edge, in which the sharpening operation can be performed extremely efficient and with less skill being required by the operators, and in which the life of the blade is increased since only a minimal amount of material is removed during each sharpening operation. Furthermore, the improved sharpening device requires only a usual source of electric power for rotating the blade holder collet and grinding wheel; and in which the blade holder and grinding wheel are controlled manually from one position on the sharpener.

Accordingly, the improved circular blade sharpening device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved circular blade sharpening device is constructed and used, the characteristics of the construction, and the advantageous, new and useful results obtained; the new and useful structures, devices, elements, arrangements, parts, and combinations, are set forth in the appended claims.

What is claimed is:

1. A sharpening device for the cutting edge of a circular-shaped knife blade of a meat trimming knife after removal of the blade from the knife, said device including:

(a) a base;

(b) a power driven blade holder movably mounted on the base for movement in a predetermined horizontal linear path on said base, said blade holder having an electric drive motor and check means for rigidly mounting the blade for rotation by said motor for preventing relative movement between the blade and the chuck means during sharpeining;

(c) a grinder having a power driven rotating grinding wheel movably mounted on the base for movement in a horizontal linear path which intersects the horizontal linear path of the blade holder whereby the grinding wheel engages and passes beyond the cutting edge of a knife blade mounted on the blade holder at a predetermined angle for sharpening said cutting edge; and (d) manually actuated sharpening control means for individually reciprocally moving the grinding wheel and blade holder along their respective horizontal paths to bring the wheel into initial contact with the cutting edge of the blade, with said control means further including vernier means for effecting a subsequent predetermined limited horizontal movement along the horizontal linear path of one of the blade holder and grinder to sharpen the blade cutting edge by grinding a predetermined amount of material from the blade by said limited horizontal movement as the other of said blade holder and grinder is reciprocated along its horizontal linear path causing momentary linear crossing contact between the grinding wheel and the blade cutting edge.

2. The sharpening device defined in claim 1 in which the sharpening control means includes a helically threaded shaft slidably rotatably mounted on the base and follower pin means operatively connecting the threaded shaft with one of the blade holder and grinding wheel for moving said one of the blade holder and grinding wheel linearly along the base upon manual rotation of the threaded shaft.

3. The sharpening device defined in claim 2 in which the threaded shaft is spring biased in an outward direction by a coil spring engaged with an inner end of said shaft.

4. The sharpening device defined in claim 3 in which the threaded shaft has a reduced diameter outer end which extends outwardly of the base through a threaded hole formed in the base; in which the vernier means includes a lever having an externally threaded hollow hub threadably mounted in the threaded hole of the base; in which the outer end of the shaft extends through the hollow hub bore; and in which the lever hub abuts against the shaft and upon rotational movement of the hub through a predetermined arcuate distance overcomes the bias of the spring moving said shaft and connected one of the blade holder and grinding wheel a predetermined linear distance to grind a predetermined amount of material from the blade.

5. The sharpening device defined in claim 4 in which a handwheel is mounted on the extended end of the threaded shaft for manually rotating the shaft for linearly moving the connected one of the blade holder and grinding wheel along the base through the connection with the follower pin means.

6. The sharpening device defined in claim 4 in which the predetermined limited linear movement between the blade and grinding wheel affected by the vernier means is approximately 0.01 inches.

7. The sharpening device defined in claim 4 in which the vernier means lever is pivoted through an arc of approximately 55° for obtaining the limited blade sharpening movement.

8. The sharpening device defined in claim 7 in which a stop pin is mounted on the lever and engages the base to regulate the limited pivotal movement of said lever.

9. The sharpening device defined in claim 3 in which a ball is mounted between the inner end of the shaft and the spring.

10. The sharpening device defined in claim 4 in which the base includes a horizontal top surface; and in which guide rails are mounted on the top surface for movably supporting the blade holder and grinding wheel for horizontal movement along said top surface.

11. The sharpening device defined in claim 10 in which the base is formed with horizontally extending cylindrical-shaped opening means for slidably rotatably mounting the threaded shaft therein.

12. The sharpening device defined in claim 2 in which the follower pin means includes a follower pin and a block formed with a horizontal hole through which the threaded shaft extends; in which the said one of the blade holder and grinding wheel is attached to said block; and in which the follower pin is mounted on the block and projects into the horizontal block hole and engages threads formed on the threaded shaft.

13. The sharpening device defined in claim 1 in which the blade holder includes a housing containing the electric motor; in which the means for rigidly rotatably mounting the blade is a collet mounted on the housing; and in which the blade holder is movably mounted on the base on a pair of slide rails.

14. The sharpening device defined in claim 13 in which the sharpening control means is operatively engaged with the blade holder for moving said holder and mounted blade with respect to the grinding wheel.

15. The sharpening device defined in claim 1 in which the grinder includes an electric motor for rotating the grinding wheel; and in which the motor and grinding wheel are movably mounted on a pair of slide rails mounted on the base.

16. The sharpening device defined in claim 15 in which the sharpening control means is operatively cngaged with the grinder for moving the motor and grinding wheel with respect to the blade holder.

17. The sharpening device defined in claim 1 in which the paths of movement of the blade holder and grinder intersect and form an included angle of approximately 65° to provide a 25° angle on the cutting edge of the knife blade.

18. The sharpening device defined in claim 13 in which the blade holder housing is pivotally mounted on a platform; and in which the platform is mounted on the slide rails to provide movement of the blade holder along its horizontal linear path.

19. The sharpening device defined in claim 18 in which the platform is formed with an arcuate-shaped groove; in which locking means is located within the platform groove and is engageable with the blade holder housing for maintaining the housing in a predetermined adjusted position on said platform to effect a predetermined crossing contact angle between the grinding wheel and blade cutting edge.

20. The sharpening device defined in claim 19 in which the locking means includes a rod having a head complementary to the arcuate-shaped platform groove and is slidably moveable in said groove; in which a clamping nut is mounted on the locking means rod and engages the blade holder housing for clamping the housing against the platform to secure said housing in an adjusted position.

21. The sharpening device defined in claim 19 in which stop means is mounted on the platform for limiting the pivotal movement of the blade holder housing thereon.

22. The sharpening device defined in claim 21 in which the stop means includes a pair of set screws which extend into the arcuate-shaped groove and engage the locking means upon the blade holder housing being pivotally moved to a predetermined adjusted position.

23. The sharpening device defined in claim 18 in which the blade holder housing is pivotally moveable through an angle of approximately 65°.

24. The sharpening device defined in claim 15 in which a gear rack is mounted on the grinder motor; and in which a gear is rotatably mounted on a shaft of a handwheel and engages the gear rack for moving the grinding wheel along its linear horizontal path.

25. The sharpening device defined in claim 1 in which the power driven blade holder electric drive motor is reversible. in which the grinder includes an electric drive motor for rotating the grinding wheel; and in which switch means are engageable with the blade holder and grinder for electrically controlling said drive motors.

26. The sharpening device defined in claim 25 in which the switch means include a pair of limit switches having spring biased plungers which are actuated upon a predetermined movement of the grinder motor and blade holder motor.

27. A sharpening device for the cutting edge of a cirular-shaped knife blade for a meat trimming knife after removal of the blade from the knife, said device including:

(a) a base;

(b) a power driven blade holder movably mounted on the base for rotatably mounting a knife blade, said blade holder having a housing and a collet for rigidly rotatably mounting the blade for preventing relative movement between the blade and the collet during sharpening, and an electric motor located within the housing for rotating said collet and blade, said blade holder being movable in a predetermined horizontal linear path on said base;

(c) a grinder having a power driven rotating grinding wheel movably mounted on the base for movement in a horizontal linear path which intersects the horizontal linear path of the blade holder whereby the grinding wheel engages and passes beyond the cutting edge of a knife blade mounted on the collet of the blade holder at a predetermined angle for sharpening said cutting edge; and (d) manually actuated sharpening control means for individually reciprocally moving the grinding wheel and blade holder along their respective horizontal paths to bring the wheel into initial contact with the cutting edge of the blade, with said control means further including vernier means for effecting a subsequent predetermined limited horizontal movement along the horizontal lienar path of one of the blade holder and grinder to sharpen the blade cutting edge by grinding a predetermined amount of material from the blade by said limited horizontal movement as the other of said blade holder and grinder is reciprocated along its horizontal linear path causing momentary linear crossing contact between the grinding wheel and the blade cutting edge.

28. The sharpening device defined in claim 27 in which the blade holder housing is pivotally mounted on a platform; and in which the platform is mounted on slide rails located on the base to provide movement of the blade holder along its horizontal linear path.

29. The sharpening device defined in claim 27 in which the electric motor is reversible.

* * * * *